US012013211B2

(12) United States Patent
McCall, Jr. et al.

(10) Patent No.: US 12,013,211 B2
(45) Date of Patent: Jun. 18, 2024

(54) RIFLE SCOPE WITH DUAL CANTING INDICATORS

(71) Applicant: John A. McCall, Jr., Grapeland, TX (US)

(72) Inventors: John A. McCall, Jr., Grapeland, TX (US); Kensuke Sakai, Suwa (JP)

( * ) Notice: Subject to any disclaimer, the term of this patent is extended or adjusted under 35 U.S.C. 154(b) by 0 days.

(21) Appl. No.: 17/576,648

(22) Filed: Jan. 14, 2022

(65) Prior Publication Data

US 2022/0221250 A1 Jul. 14, 2022

Related U.S. Application Data

(60) Provisional application No. 63/137,453, filed on Jan. 14, 2021.

(51) Int. Cl.
*F41G 1/44* (2006.01)
*F41G 1/34* (2006.01)
*F41G 1/38* (2006.01)

(52) U.S. Cl.
CPC ..... *F41G 1/44* (2013.01); *F41G 1/345* (2013.01); *F41G 1/38* (2013.01)

(58) Field of Classification Search
CPC ... F41G 1/34; F41G 1/345; F41G 1/38; F41G 1/44; G01C 9/24–36; G02B 7/00; G02B 7/02; G02B 23/10; G02B 23/16
USPC ..... 42/123
See application file for complete search history.

(56) References Cited

U.S. PATENT DOCUMENTS 3,556,666 A * 1/1971 Lichtenstern ..... G02B 23/14 42/123
5,005,308 A * 4/1991 Parks ..... F41G 1/38 33/366.21
5,223,650 A * 6/1993 Finn ..... F41G 1/38 42/122
6,978,569 B2 12/2005 Williamson, IV et al.
7,296,358 B1 * 11/2007 Murphy ..... F41G 1/467 33/265
7,346,400 B2 * 3/2008 Cross ..... F41G 1/345 700/13
7,530,193 B2 * 5/2009 Williamson, IV ..... F41G 1/44 42/145
8,807,430 B2 * 8/2014 Millett ..... F41G 3/06 235/407
9,310,163 B2 * 4/2016 Bay ..... F41G 1/473

(Continued)

*Primary Examiner* — Joshua E Freeman
*Assistant Examiner* — Benjamin S Gomberg
(74) *Attorney, Agent, or Firm* — John G. Fischer, Esq.; Scheef & Stone, L.L.P.

(57) ABSTRACT

The present invention discloses a canting indicating rifle scope. An eyepiece assembly is located on one end of a body tube, and an objective bell extends from the opposite end. Lenses are positioned within the scope and permit visual acuity and magnification adjustments. A reticle is located between a focus lens and an ocular lens. A level is located between the reticle and the ocular lens. A canting turret extends from a parallax turret on the body tube and contains a circuit board, a battery power source, and an accelerometer. The circuit board is electrically connected to the electronic accelerometer and to a level LED positioned to illuminate the level. The circuit board is electrically connected to a reticle LED to illuminate the reticle. An activation switch on the exterior of the turret controls the mode of illumination of the reticle and level.

17 Claims, 9 Drawing Sheets

(56) References Cited

U.S. PATENT DOCUMENTS

| | | | | |
|---|---|---|---|---|
| 10,302,396 | B1 * | 5/2019 | Ray | F41G 1/473 |
| 10,337,832 | B1 * | 7/2019 | Ratliff | F41G 1/44 |
| 10,480,900 | B2 * | 11/2019 | York | F41G 1/387 |
| 10,488,156 | B2 * | 11/2019 | York | G02B 27/34 |
| 10,534,166 | B2 * | 1/2020 | Summerfield | G02B 27/142 |
| 10,545,009 | B1 * | 1/2020 | Bartak | G01C 9/24 |
| 10,837,738 | B1 * | 11/2020 | Huang | F41G 1/38 |
| 2004/0148841 | A1 * | 8/2004 | Burzel | F41G 1/44 42/123 |
| 2013/0185981 | A1 * | 7/2013 | Brabandt | F41G 1/00 42/117 |
| 2014/0101982 | A1 * | 4/2014 | McPhee | F41G 3/323 42/130 |
| 2016/0169619 | A1 * | 6/2016 | Stockdill | F41G 1/44 33/298 |
| 2019/0376766 | A1 * | 12/2019 | Fruechtel | F41G 1/44 |
| 2020/0025518 | A1 * | 1/2020 | Nackel | F41G 1/30 |
| 2020/0109918 | A1 | 4/2020 | York et al. | |
| 2022/0221250 | A1 * | 7/2022 | McCall, Jr. | F41G 1/38 |

* cited by examiner

RIFLE SCOPE WITH DUAL CANTING INDICATORS

TECHNICAL FIELD OF INVENTION

The embodiments of the present invention relate to a new mechanism that adds a control dimension to the precision and accuracy of a scoped target. In particular, the present invention is applicable for indicating canting, or axial tilt, of a rifle being aimed at a target through a scope. More specifically, the present invention provides a mechanical and a separate electrical control measurement of rifle canting when targeting through a rifle scope, allowing an operator to rely on one or both of the indicators.

BACKGROUND OF THE INVENTION

Since the early invention of the earliest firearms there has been a never-ending pursuit of more accurate firearms at longer ranges. This necessity is primarily for military use, but also for sport. Clearly, the side with the better firearms that are more accurate, with longer range, and deadly, is at an enormous advantage. Historically, technology generally wins every war.

As firearms evolved in their accuracy and range, it became necessary to develop optics that could sight the firearm at ranges further than the human eye could focus. For this purpose, optics were employed in the form of rifle scopes. As firearm and bullet technology continued to evolve, it became necessary to further evolve rifle scopes to compensate for such things as distance (elevation), magnification, wind, and parallax. Eventually, electronic illumination was added for shooting in shadowed or lowlight environments. Digital imaging is also available, but total reliance on a portable power source and operating electronics is a significant disadvantage.

While measurements and adjustments have been designed for the cartesian coordinates and built into adjustments within rifle scopes, often neglected is the canting of the rifle itself. This being the possibility that the rifle was slightly rotated about the centerline of its barrel. It has been found that even slight rotation can severely affect the accuracy of longer shots.

In response, products are now available that provide a bubble level as an aftermarket product that can be fastened to a scope system. A primary problem with these devices is that they require leveling themselves during installation. If improperly installed or moved and not level, they provide a false indication of the canting of the rifle. A second primary disadvantage of these devices is that they require looking outside of the scope and target to determine if the rifle is canted. On a critical shot, the target can move when the operator takes his eye off the reticle.

Digital products are now available that include numerous numerical outputs within the scope, including a digital measure of tilt angle. These designs permit the operator to determine the cant or tilt of the rifle without looking external to an ocular lens—as long as there is electrical power. However, these products suffer the significant disadvantage of requiring the operator to take his or her eye off the reticle-target interface to recognize the representation among other digital outputs, to read it, and then to decide if the displayed number represents an appropriate amount of tilt. A targeted shot at significant distance can easily be lost in this interval, and long-distance shooting is the primary application of the scope's anti-canting feature.

Another disadvantage of these devices is that the numbers are necessarily very small, requiring a heightened level of focus to read them. Another disadvantage of these scopes is that they rely exclusively on electrical power to provide anti-canting functions. The failure of electronics and eventual depletion of the power supply can leave the operator defenseless.

As a result, there remains a need for a control parameter for measuring and canting of a scoped rifle that allows the operator to keep his or her full focus of the reticle target interface. There is also a need for a rifle scope system that allows the operator to immediately determine if the rifle is acceptably aligned without looking exterior of the ocular lens. There is also a need for a rifle scope system that allows the operator these benefits in the absence or failure of system electronics.

SUMMARY OF THE INVENTION

The present invention provides a substantially improved rifle scope. In particular, the present invention provides a rifle scope with dual canting indicators. The first level is a mechanical fluid canting indicator that is readable within the optics of the scope. The second level is an electronic "go" illumination within the optics of the scope.

In one embodiment, a rifle scope is provided, comprising an eyepiece assembly on one end of a body tube. An objective bell extends from the opposite end of the body tube. A plurality of lenses is positioned within the scope which permit visual acuity and magnification adjustments.

In one embodiment, an objective lens is mounted in the objective bell. An ocular lens is mounted within the body tube proximate the eyepiece assembly. A focus lens is mounted between the objective lens and the ocular lens. A reticle is located between the focus lens and the ocular lens. A level is located between the reticle and the ocular lens. A canting turret extends from a first side of the body tube. The canting turret comprises a circuit board connectable to a battery power source. An accelerometer is connected to the circuit board.

The circuit board is electrically connected to a reticle LED positioned to illuminate the reticle. The circuit board is electrically connected to a level LED positioned to illuminate the level. An activation switch is electrically connected to the canting turret.

In another embodiment, the level is a fluid level having an arc radius in which a bubble in the fluid indicates the true vertical. The fluid may be colored for readability. In one embodiment, the bubble is sized to represent a known angle of arc, such that the amount of tilt of the rifle is measurable against the reticle position as viewed against the bubble.

In another embodiment, indicia are located on the level on either side of the bubble (when level) at a known angle of arc, such that the amount of tilt of the rifle is measurable by the bubble's position relative to the indicia on the level.

In another embodiment, the level assembly comprises a level frame. The level and the level LED are mounted to the level frame. In another embodiment, a backing ring is connected to the level frame.

In another embodiment, an illumination control switch is located on the exterior of the canting turret, and electrically connected to the circuit board to increase or decrease the illumination of the reticle and/or level LED.

In another embodiment, an increase illumination switch and a decrease illumination switch are located on the exterior of the canting turret and are each connected to the circuit board.

In another embodiment, a timer is electrically connected to the circuit board, and is initiated by the activation switch. The timer initiates a sleep mode and terminates electrical power to the reticle LED and the level LED at the expiration of a first predetermined amount of time.

In another embodiment, a movement sensor for detecting movement of the scope is electrically connected to the circuit board. The movement sensor reactivates the last active mode and levels of illumination to the level LED and the reticle LED after power termination by initiation of the sleep mode by the timer. In one embodiment, the movement sensor is an accelerometer. In another embodiment, the movement sensor function is performed by the same accelerometer that measures inclination of the scope.

In another embodiment, a plurality of activation modes is provided. In a first activation mode, power is supplied to the level LED and not to the reticle LED. In a second activation mode, power is supplied to the reticle LED and the level LED. In a third activation mode, power is supplied to the reticle LED and not to the level LED. In a fourth activation mode, power is supplied to the timer and the movement sensor, but not to the reticle LED or the level LED. In a fifth mode, the circuit board is unpowered and deactivated. This is the "power off" mode.

In another embodiment, the accelerometer detects the angle of canting of the rifle scope, and the circuit board conditions illumination of the level LED upon the detected angle of canting being less than a predetermined amount.

In another embodiment, the level LED is green to indicate the rifle is not excessively canted. In another embodiment, a different colored LED may indicate the rifle is excessively canted.

In another embodiment, an erector assembly including magnifying lenses is located between the reticle and the ocular lens.

In another embodiment, the battery power source is replaceable or rechargeable through a battery cap located on the canting turret.

As will be understood by one of ordinary skill in the art, the assembly disclosed may be modified and the same advantageous result obtained.

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

The following description is presented to enable any person skilled in the art to make and use the invention and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown but is to be accorded the widest scope consistent with the principles and features disclosed herein.

Figure 1:
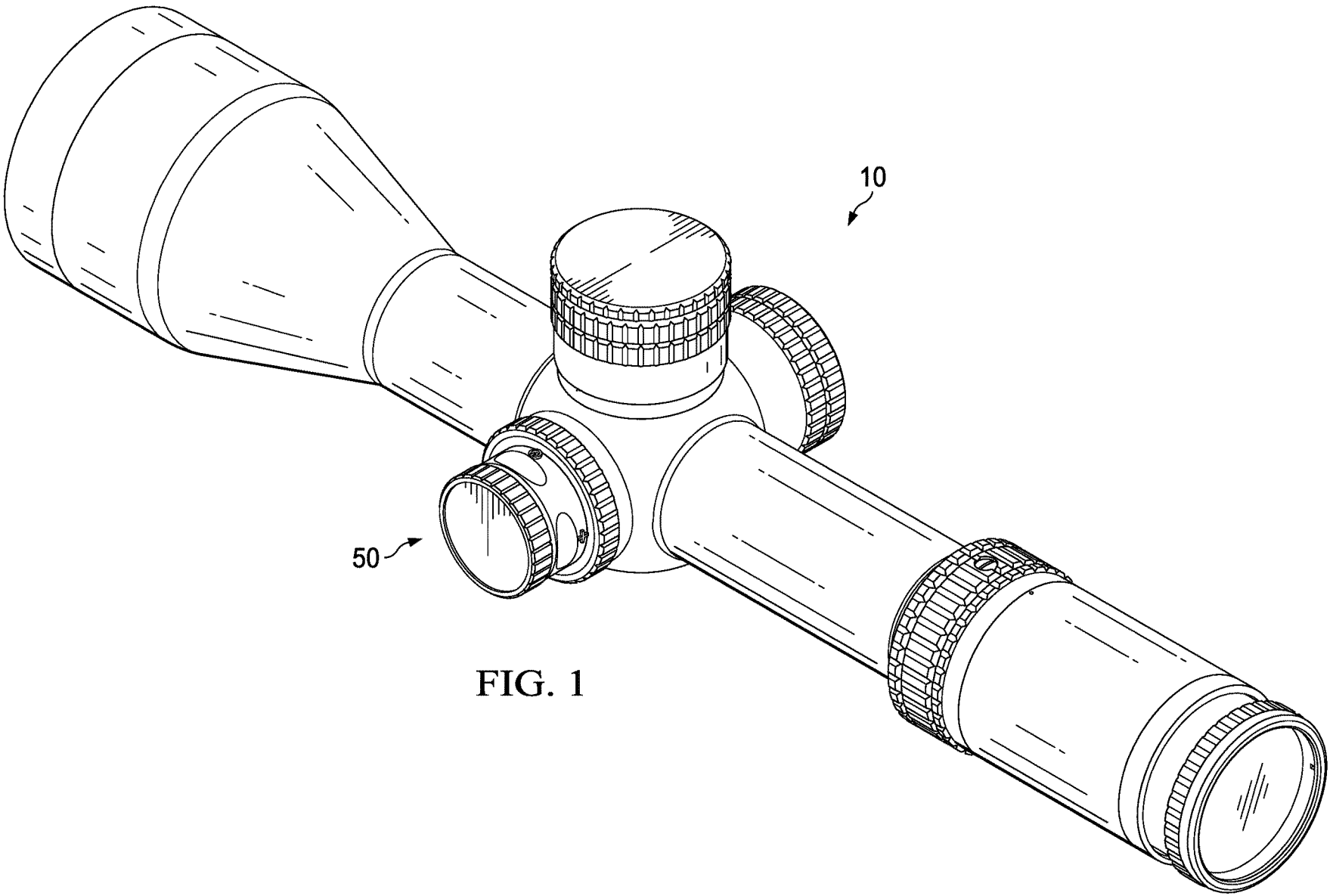
FIG. 1 is an isometric view of an embodiment of the rifle scope 10 of the present invention.

FIG. 1 is an isometric view of an embodiment of rifle scope 10 of the present invention. A canting turret 50 extends from the left side of scope 10.

Figure 2:
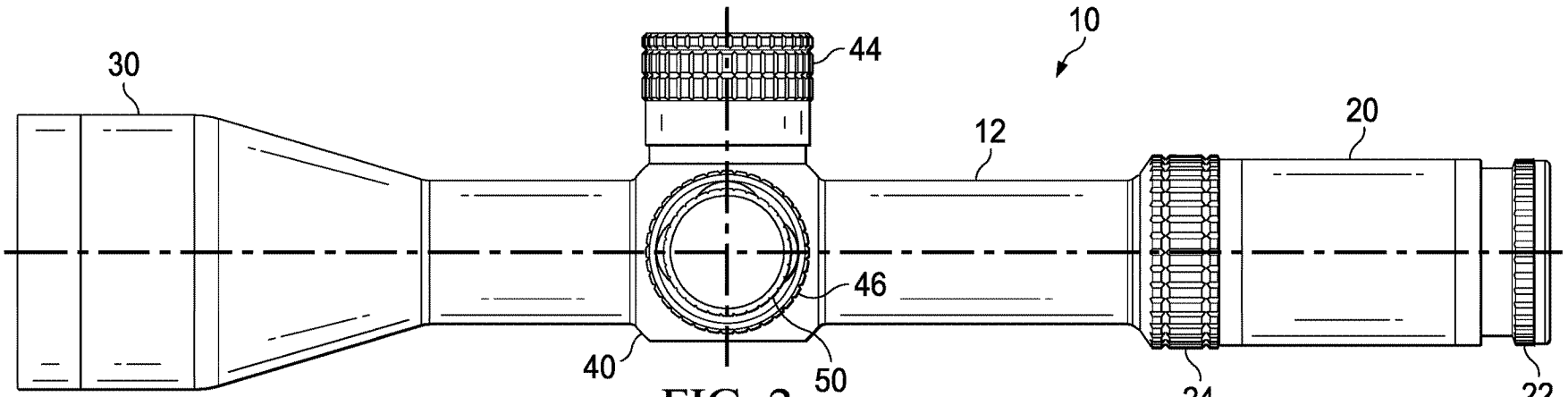
FIG. 2 is a left side view of an embodiment of the rifle scope of the embodiment of FIG. 1.

FIG. 2 is a left side view of the embodiment of rifle scope 10 illustrated in FIG. 1. Rifle scope 10 has a body tube 12. An eyepiece assembly 20 is located on one end of body tube 12. An objective bell 30 is located at the opposite end of body tube 12.

Eyepiece assembly 20 has a diopter adjustment 22 and a magnification (or power) adjustment 24. A turret housing 40 is located on body tube 12. Canting turret 50 is located on the turret housing 40.

Figure 3:
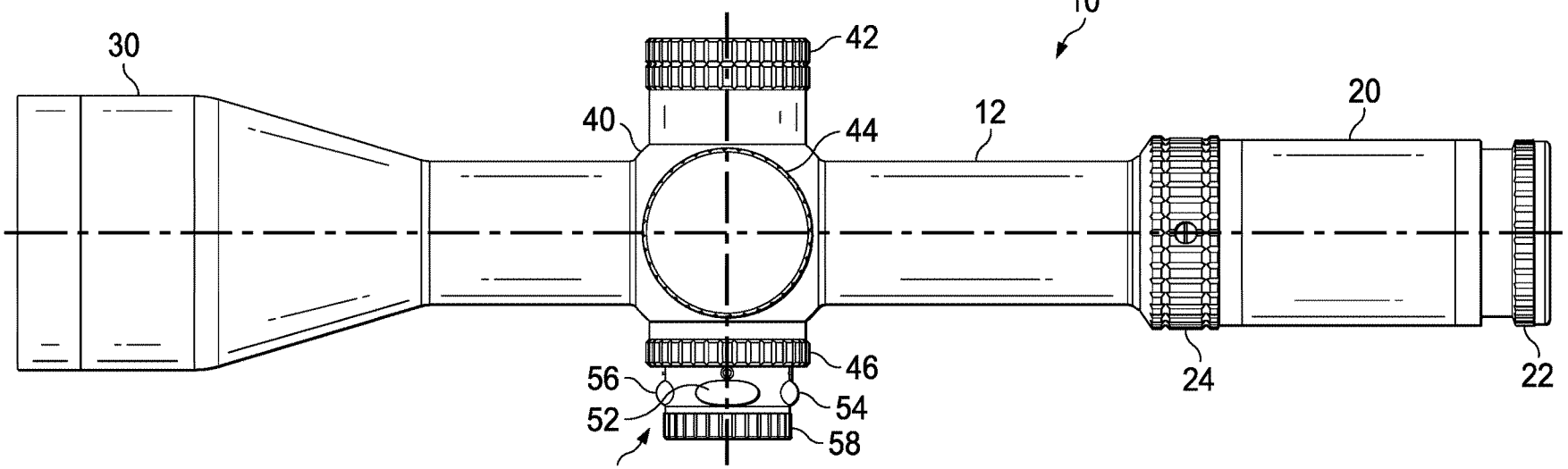
FIG. 3 is a top view of an embodiment of the rifle scope of the embodiment of FIG. 1.

FIG. 3 is a top view of the embodiment of rifle scope 10 of FIG. 1. As seen in FIG. 3, turret housing 40 is located between eyepiece assembly 20 and objective bell 30. A windage turret 42 extends from the right side of turret housing 40. An elevation turret 44 extends from the top of turret housing 40. A parallax turret 46 extends from the left side of turret housing 40.

Unique to the present invention, canting turret 50 extends outward from parallax turret 46. This has proven extremely convenient for the shooter to access and control. This is significant, as less convenient controls necessarily distract the shooter from maintaining focus on the target. In the embodiment illustrated, canting turret 50 comprises an activation switch 52, an illumination up switch 54, and an illumination down switch 56. A battery cap 58 is secured to the end of canting turret 50 to provide ready access to replace a battery 62 (shown in FIG. 6) which, in place, is electrically connected to a circuit board 60.

Figure 4:
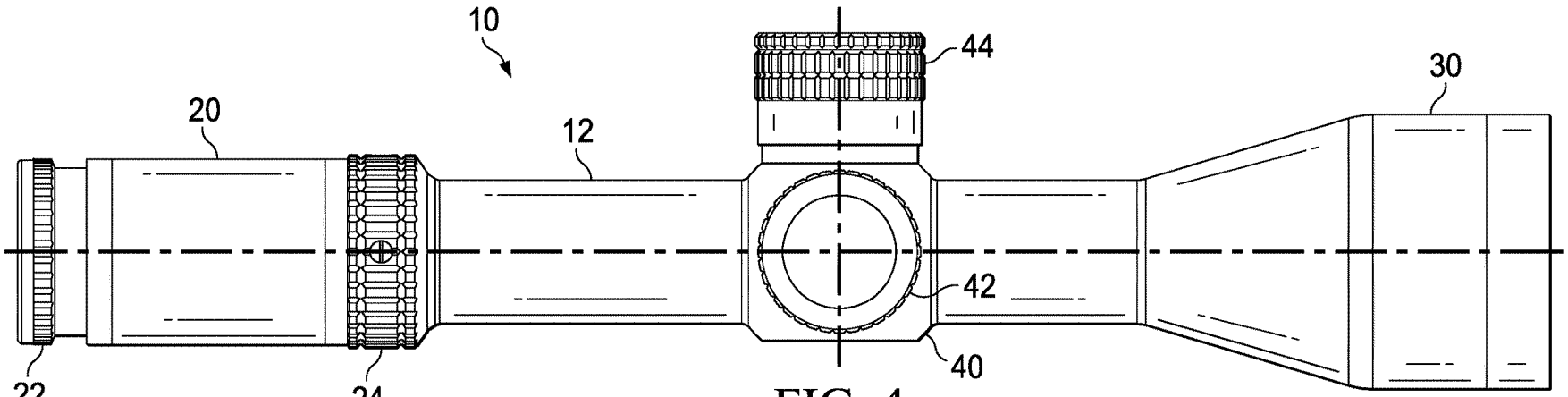
FIG. 4 is a right side view of an embodiment of the rifle scope of the embodiment of FIGS. 1-3.

FIG. 4 is a right side view of the embodiment of rifle scope 10 shown in FIGS. 1-3.

Figure 5:
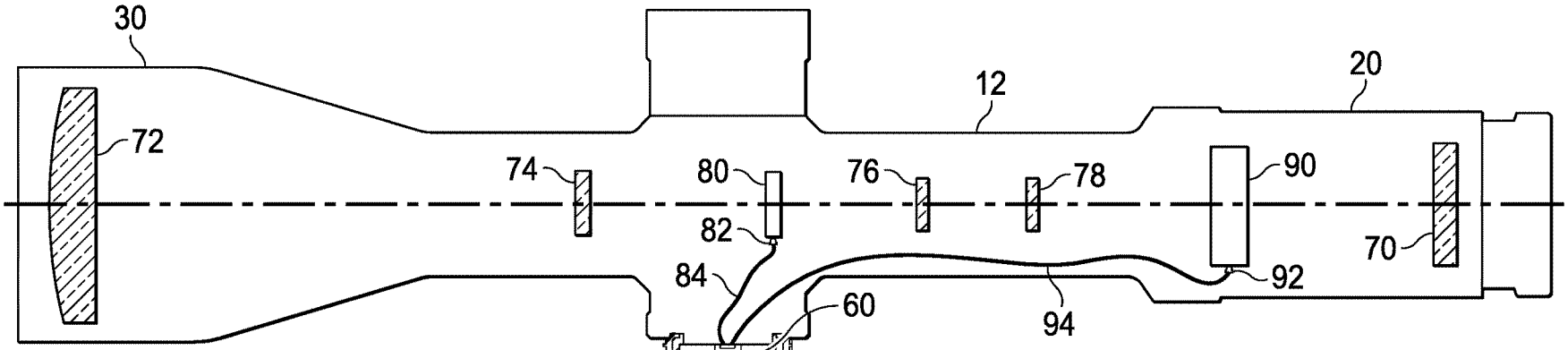
FIG. 5 is a top cross-sectional view of an embodiment of the rifle scope of the embodiment of FIGS. 1-4.

FIG. 5 is a top cross-sectional view of the embodiment of FIGS. 1-4. As seen in FIG. 5, the interior of rifle scope 10 comprises a series of lenses. An ocular lens 70 is located in eyepiece 20. An objective lens 72 is located in objective bell 30. A focus lens 74 is located interior to body tube 12. Magnifying lenses 76 and 78 are located in an erector assembly 75 (not shown) which is subject to lateral repositioning by windage adjustment 42 and to vertical repositioning by elevation adjustment 44.

A reticle 80 is located between ocular lens 70 and objective lens 72. Reticle 80 has a reticle LED 82 positioned to illuminate reticle 80 when power is transmitted to a second electrical connector 84 which is electrically connected to canting turret 50.

As best seen in FIG. 3, activation switch 52 is located on the top of canting turret 50. Illumination up switch 54 is located on the ocular lens 70 side of canting turret 50. Illumination down switch 56 is located on the objective lens 72 side of canting turret 50.

Circuit board 60 is located inside canting turret 50. A battery power source 62 is located inside canting turret 50 and electrically connected to circuit board 60. Circuit board 60 is electrically connected to activation switch 52, illumination up switch 54, and illumination down switch 56. Circuit board 60 is further electrically connected to reticle LED 82 and to a level LED 92.

A level assembly 90 is located between ocular lens 70 and objective lens 72. Level assembly 90 has a level LED 92 positioned to illuminate level assembly 90 when power is transmitted to a first electrical connector 94 which is electrically connected to canting turret 50.

Figure 6:
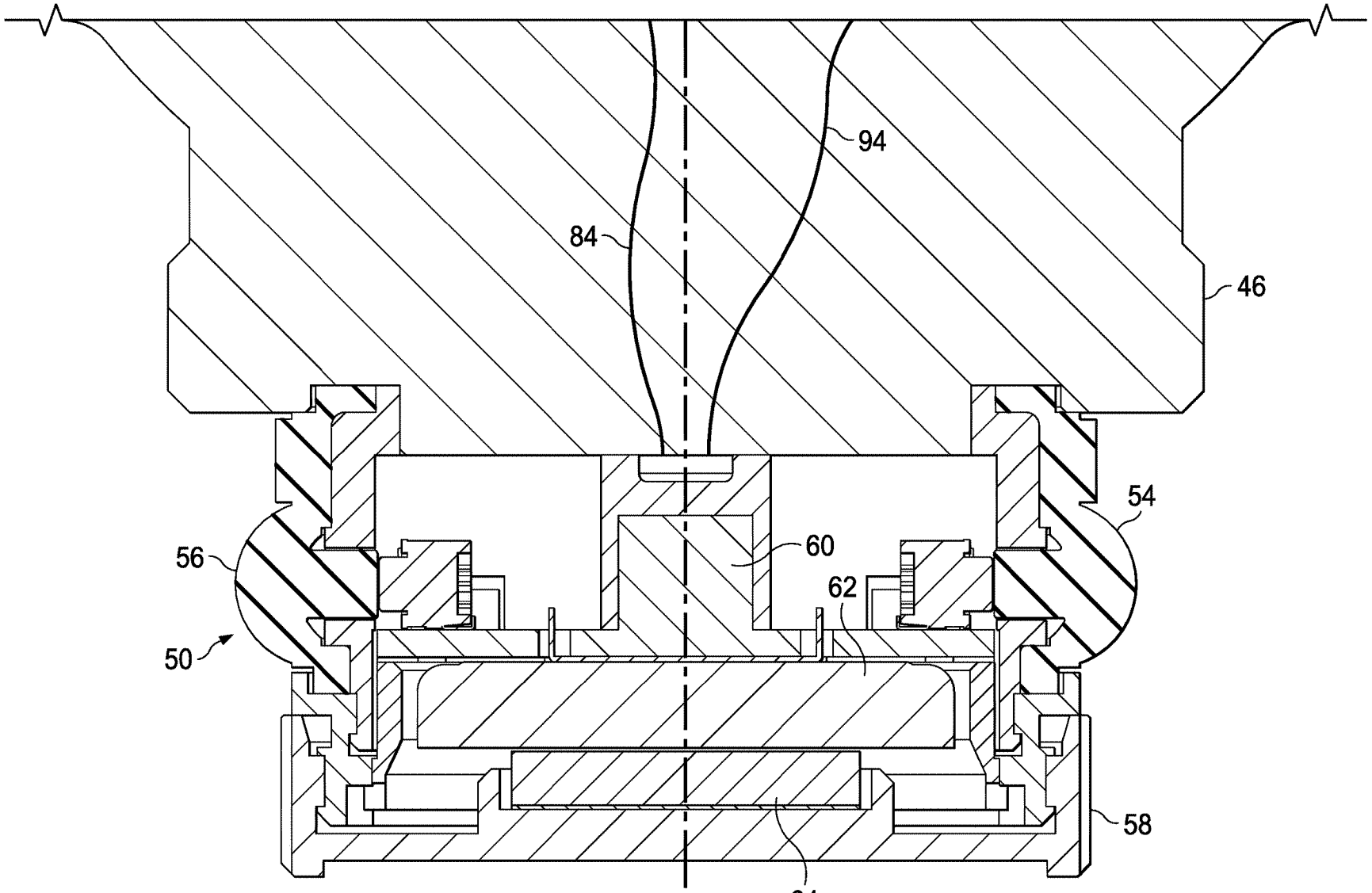
FIG. 6 is a side cross-sectional view of an embodiment of the canting turret of FIG. 5.

FIG. 6 is a cross-sectional top view of the embodiment of canting turret 50 illustrated in FIG. 5. Illumination up switch 54 is located on the operator side of canting turret 50. Illumination down switch 56 is located on the rifle muzzle side of canting turret 50.

Circuit board 60 is located inside canting turret 50. Battery power source 62 is located inside canting turret 50 and electrically connected to circuit board 60. Circuit board 60 is further electrically connected to activation switch 52, illumination up switch 54, and illumination down switch 56. As was seen in FIG. 5, circuit board 60 is electrically connected to reticle LED 82 and to level LED 92 by electrical connectors 84 and 94, respectively. Battery cap 58 may secure battery 62 in electrical connection to circuit board 60 by means of a spring or compressible battery pad 64.

Figure 7:
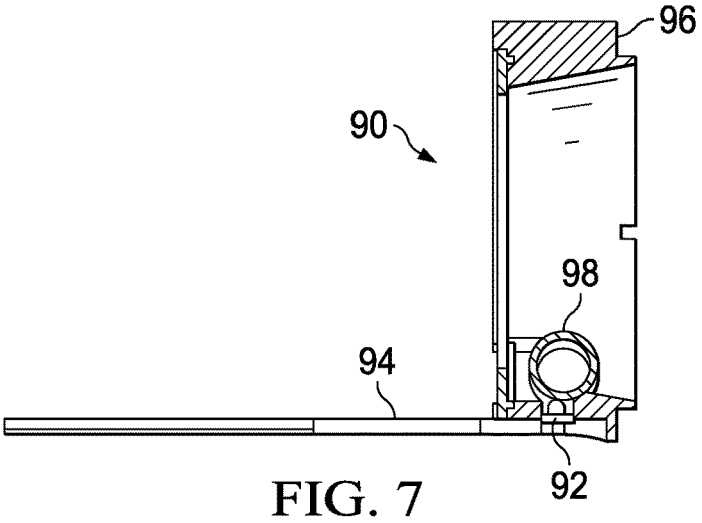
FIG. 7 is a side cross-sectional view of an embodiment of the level assembly of the present invention.

FIG. 7 is a side cross-sectional view of an embodiment of level assembly 90 of rifle scope 10. As seen in FIG. 7, level assembly 90 comprises a level frame 96. A level 98 is mounted in level frame 96 above level LED 92. As seen in FIG. 7, level 98 is positioned directly above level LED 92 such that when power is transmitted through first electrical connector 94, level LED 92 will illuminate level 98.

Figure 8:
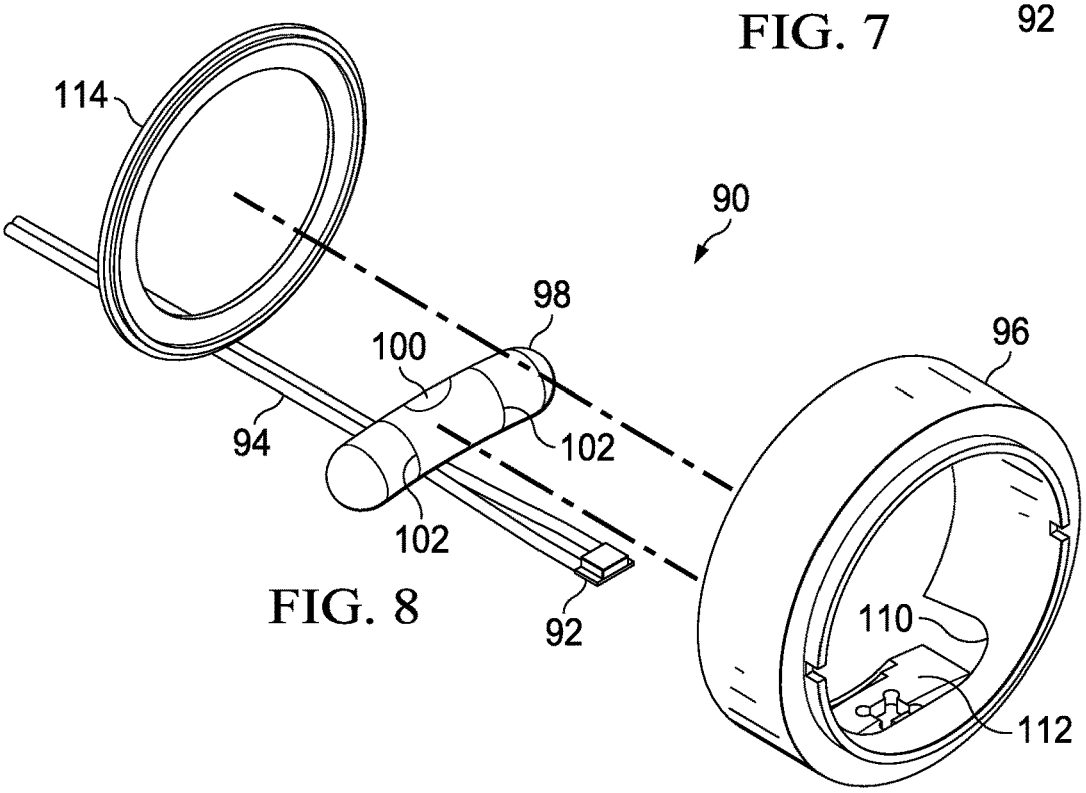
FIG. 8 is an isometric exploded view of the embodiment of the level assembly of FIG. 7.

FIG. 8 is an isometric exploded view of the embodiment of level assembly 90 of FIG. 7. In one embodiment, level 98 is an arced and fluid-filled level that includes a bubble 100. Level 98 may be filled with a colored fluid to provide contrast to the air or gas of bubble 100. In one embodiment, the volume, and thus the length of bubble 100, is precisely controlled to represent a predetermined angle of arc within level 98.

In this embodiment, should the electrical power be lost, the operator can still see the intersection of the lower section of reticle 80 with bubble 100 as seen within ocular lens 70. As long as they intersect, the rifle is positioned within the predetermined amount of allowable tilt, and the operator need not look external of the scope optics. In another embodiment, reticle 80 intersects bubble 100 only within the same predetermined angular amount of canting required to illuminate level LED 92.

In one embodiment, the length of bubble 100 represents two degrees of angle within level 98, such that intersection of bubble 100 with reticle 80 will indicate canting within a predetermined allowable angle of one degree.

In another embodiment, indicia 102 are inscribed on level 98 on either side of bubble 100 (when level) at a predetermined angle of arc, such that the amount of tilt of scope 10 (and thus the rifle) is measurable by the bubble's 100 position relative to indicia 102 on level 98.

In one such embodiment, a pair of indicia 102 is inscribed on level 98 and separated by a distance equal to the length of bubble 100 plus two times the predetermined angular amount of allowable canting, such that bubble 100 is located between the pair of indicia 102 when scope 10 is within the same predetermined angular amount of canting required to illuminate level LED 92. In another embodiment, indicia 102 are located at one degree of angle beyond each end of bubble 100 when oriented level.

Figure 9:
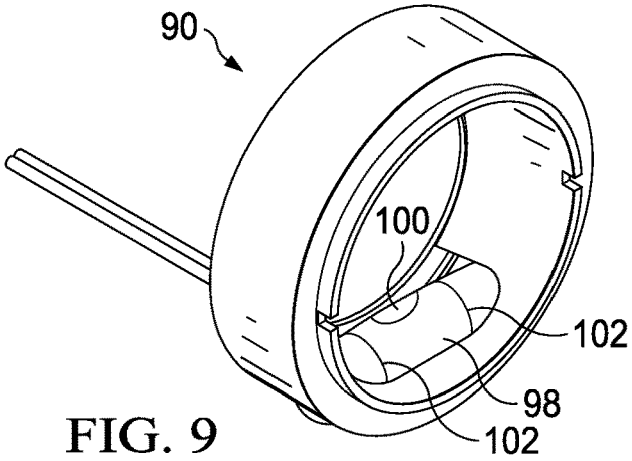
FIG. 9 is an isometric view of the embodiment of the level assembly of FIGS. 7 and 8.

As seen in FIG. 8, level frame 96 has a slot 110 for receiving level 98. A platform 112 is provided for receiving level LED 92. In one embodiment, a backing ring 114 secures level 98 inside level frame 96. FIG. 9 is an isometric view of the embodiment of level assembly 90 of FIGS. 7 and 8 shown as assembled.

Figure 10:
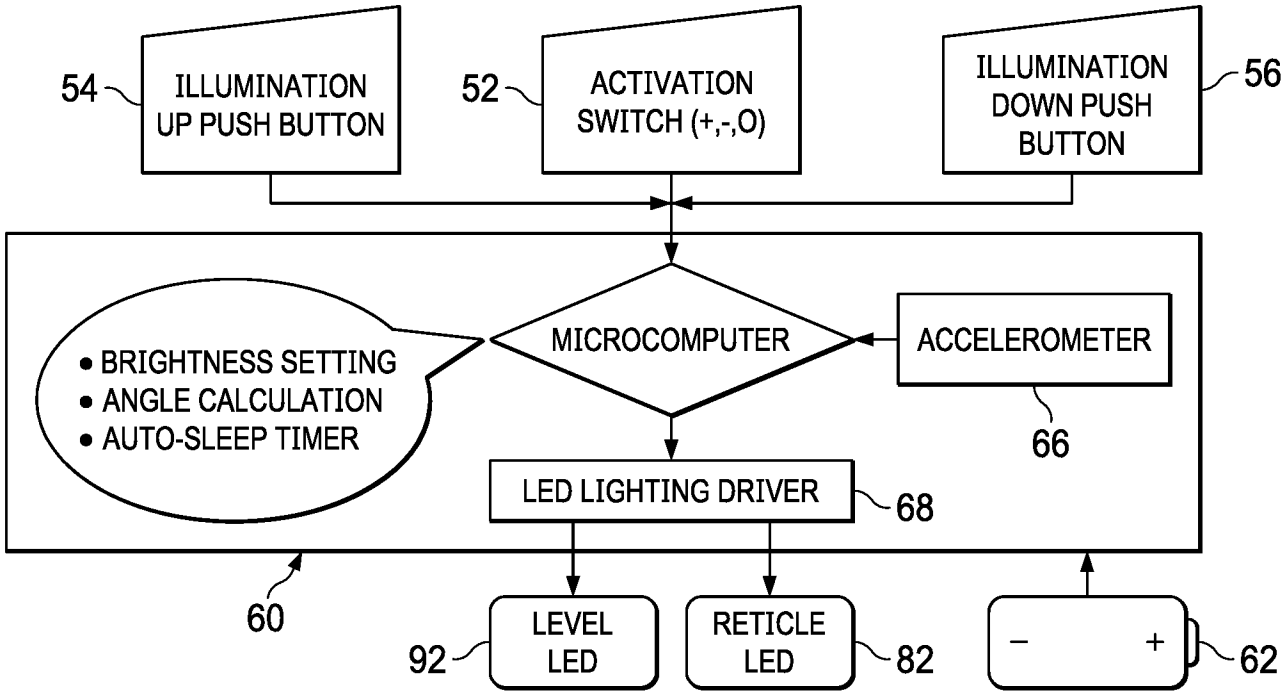
FIG. 10 is a summary operations chart of an embodiment of the circuit board.

FIG. 10 is a general schematic of an embodiment of circuit board 60. Circuit board 60 is connected to battery power source 62. Circuit board 60 is electrically connected to an accelerometer 66, or other movement detecting sensor, and a timer. Circuit board 60 is connected to activation switch 52, illumination up switch 54 and illumination down switch 56.

Circuit board 60 includes an LED lighting driver 68 which controls the intensity of the LED brightness in response to signals received from illumination up switch 54 and illumination down switch 56. Circuit board 60 is thereby electrically connected to level LED 92 and reticle LED 82.

Figure 11:
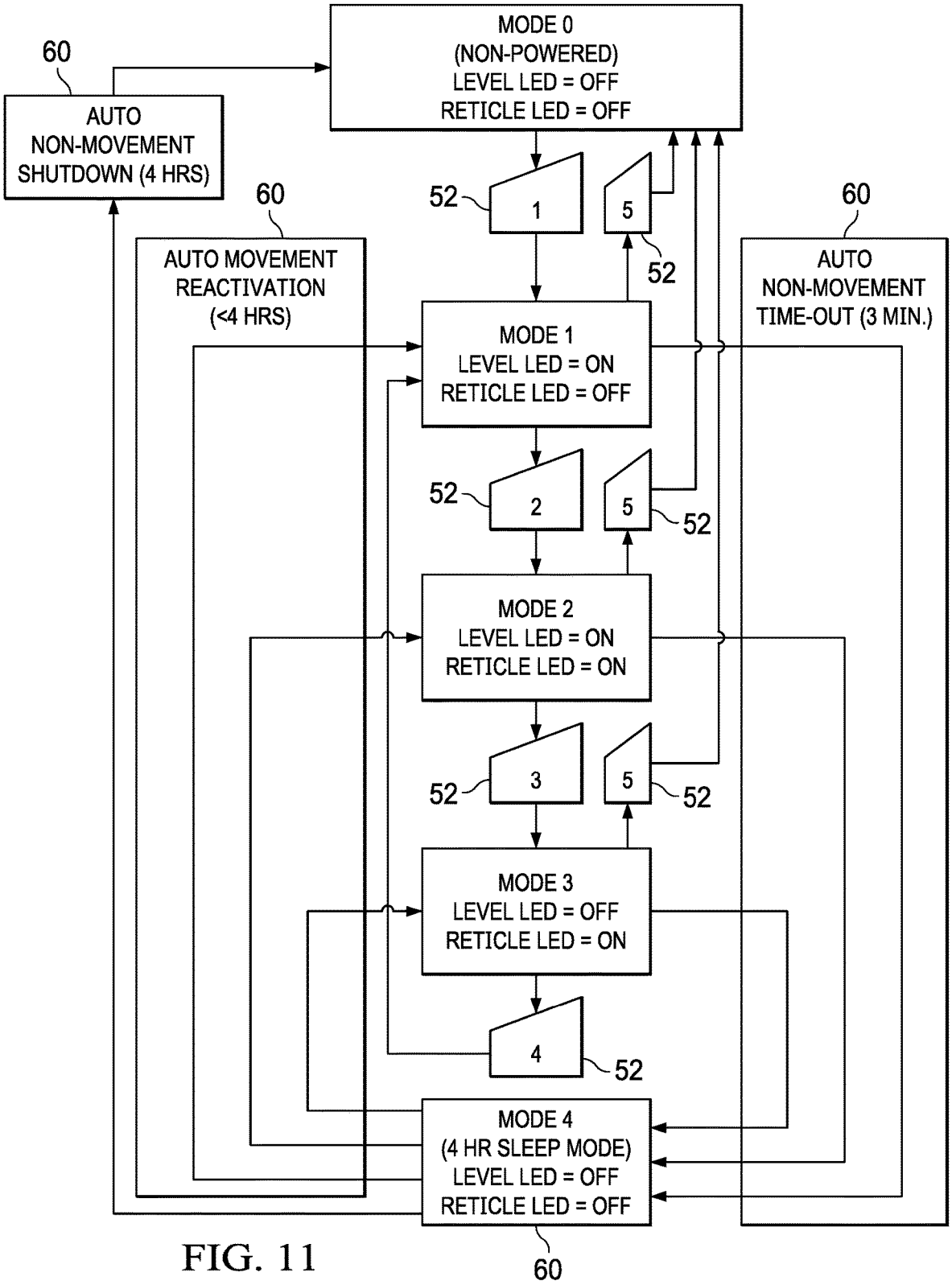
FIG. 11 is a flow chart representing an embodiment of the modes of operation activated by the operator and the modes of operation automatically activated by the rifle scope.

FIG. 11 is a flow chart representing an embodiment of modes of operation. In the embodiment illustrated, four modes (Modes 1, 2, 3 and 0) are selectable by the operator by pressing activation switch 52. Mode 0 being the off, or unpowered mode, in which scope 10 remains functional.

In this same embodiment, five modes (Modes 1, 2, 3, 4, and 0) are activated automatically by circuit board 60. Circuit board 60 selects a mode based on either 1) the expiration of a first predetermined time period, 2) the expiration of a second predetermined time period, or 3) in response to sensor 66 detecting movement of scope 10 prior to the expiration of the second predetermined time period.

Figure 15:
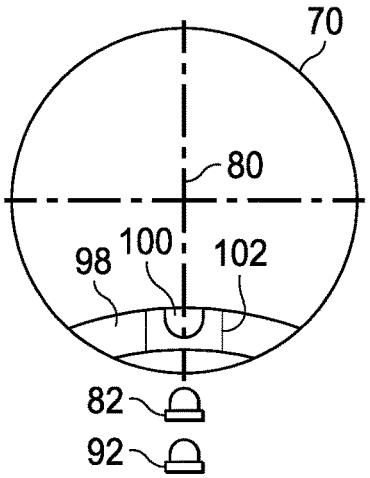
FIG. 15 illustrates the view through the eyepiece when the scope is in a non-powered (or fourth "sleep state") mode of an embodiment of the invention, in which the level indicates a non-canted inclination.

Referring to the top of the center column of FIG. 11, a non-powered mode, designated Mode 0, is the resting state of scope 10. All electrical power is conserved and scope 10 is "turned off". Important to the present invention, in a non-powered mode, scope 10 is functional for shooting and provides an indication of allowable canting that is visible through diopter adjustment 22, as seen in FIG. 15. This capability prevents the operator from being defenseless or unable to align an accurate long-distance shot in the absence of electrical power.

From Mode 0, the operator activates Mode 1 by pressing activation switch 52 (see FIG. 11, input box 1). This provides power from battery power source 62 to circuit board 60. In Mode 1, level LED 92 is activated. As such, when rifle scope 10 is not canted or within the predetermined range of allowable canting, level LED 92 will illuminate level 98. In one embodiment, the allowable range of canting is 1°.

Once activated, the operator may cycle through Mode 1, Mode 2, and Mode 3 and back to Mode 1 by momentarily pressing activation switch 52. This capability is indicated by input boxes 52 that are internally numbered as 1, 2, and 3.

From each of Modes 1, 2, and 3, the operator can select Mode 0, which is to turn the power to scope 10 off, by a quick press and release of activation switch 52 (see FIG. 11, input boxes 5). Circuit board 60 distinguishes the duration of a quick press and release of activation switch 52 from a momentary pressing of activation switch 52, thus allowing activation switch 52 to perform the two separate functions.

To activate Mode 2, the operator presses activation switch 52 once from Mode 1 (see FIG. 11, input box 2). In Mode 2, level LED 92 is powered when accelerometer 66 indicates that rifle scope 10 is level within the predetermined angular tolerance, and reticle LED 82 is also powered.

To activate Mode 3, the operator presses activation switch 52 once from Mode 2. In Mode 3, only reticle LED 82 is powered (see FIG. 11, input box 3). From Mode 3, the operator presses activation switch 52 once again to reenter Mode 1 (see FIG. 11, input box 4).

In each of the Modes 1, 2, and 3, the operator can increase or decrease the intensity of the illuminated level LED 92 or reticle LED 82 of that mode by pressing illumination up switch 54 or illumination down switch 56, as seen in FIG. 3.

In each of the Modes 1, 2, and 3, activation initiates the timer to run for a first predetermined amount of time. In one embodiment, the first predetermined amount of time is 3 minutes. Each detection of movement of rifle scope 10 by sensor 66 restarts the timer. In this manner, each of Modes 1, 2, and 3 remains activated as long as there is any movement detected by sensor 66 within the first predetermined period of time.

As shown on the right side of FIG. 11 [AUTO NON-MOVEMENT TIME-OUT], in the absence of any detection of movement by sensor 66 before the expiration of the first predetermined period of time, circuit board 60 will automatically shift scope 10 into a fourth mode (Mode 4), which is a "sleep" mode. In Mode 4, power to level LED 92 and reticle LED 82 is terminated, and battery power 62 is substantially (mostly) conserved.

As shown on the left side of FIG. 11 [AUTO MOVEMENT REACTIVATION] when in Mode 4, detection of movement by sensor 66 before the expiration of a second predetermined period of time will cause scope 10 to revert to the last mode of operation (Modes 1, 2, or 3) and to the illumination settings activated prior to automatically switching to Mode 4.

In Mode 4, the absence of detection of movement by sensor 66 before expiration of the second predetermined period of time will cause circuit board 60 to automatically power off scope 10 (Mode 0). See [AUTO NON-MOVEMENT SHUTDOWN]. When unpowered, no timers are running, no LEDs are powered, and battery power 62 is fully conserved. No movement of rifle scope 10 will cause it to power back up. It is then necessary to press activation switch 52 to cause scope 10 to power up in Mode 1.

It will be understood to a person of ordinary skill in the art that the precise number and sequence of the modes of operation illustrated herein can be varied without departing from the novelty of the disclosure of the invention.

Figure 12:
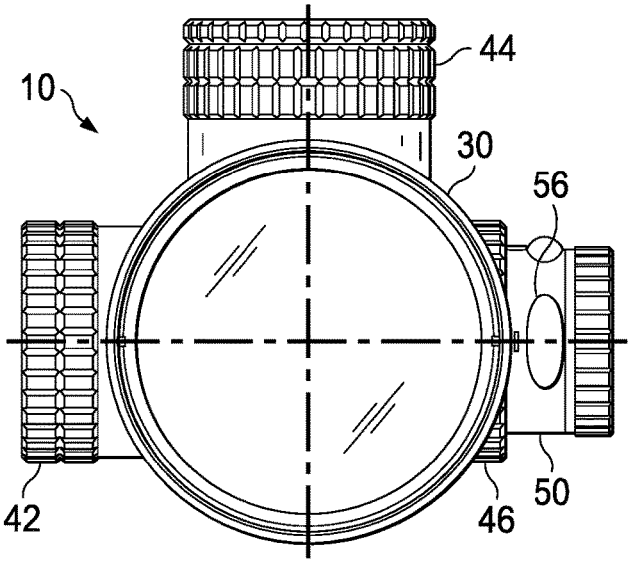
FIG. 12 is a front view of an embodiment of the rifle scope of the present invention.

FIG. 12 is a front view of the embodiment of rifle scope 10 illustrated in FIG. 1. In this view, looking towards objective bell 30, rifle scope 10 is shown in a level and non-canted position.

Figure 13:
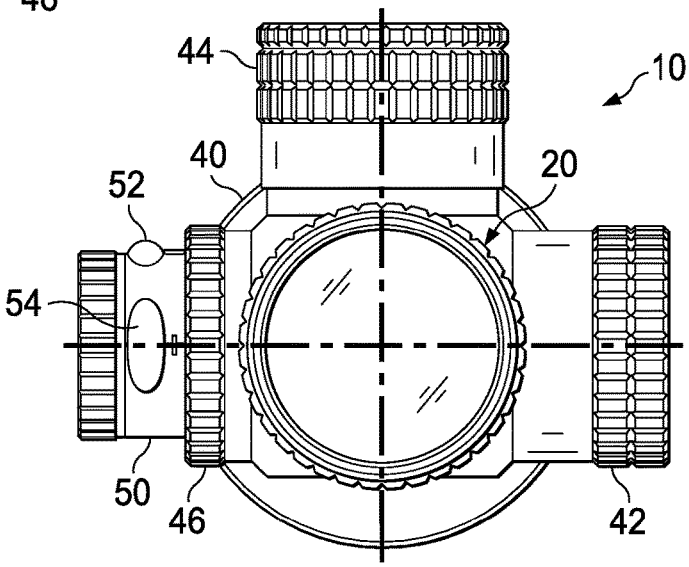
FIG. 13 is a rear view of an embodiment of the rifle scope of FIG. 12.

FIG. 13 is a rear view of the embodiment of rifle scope 10 illustrated in FIG. 12. This is the operator's view of rifle scope 10. In this view, looking towards eyepiece assembly 20, rifle scope 10 is shown in a level and non-canted position.

As seen in this view, and is conventional for rifle scopes, windage turret 42 is located on the operator's right side of rifle scope 10. Elevation turret 44 is located on the top of rifle scope 10. A parallax turret 46 is located on the left side of rifle scope 10. Unique to the present invention is canting turret 50, which extends from parallax turret 46.

Figure 14:
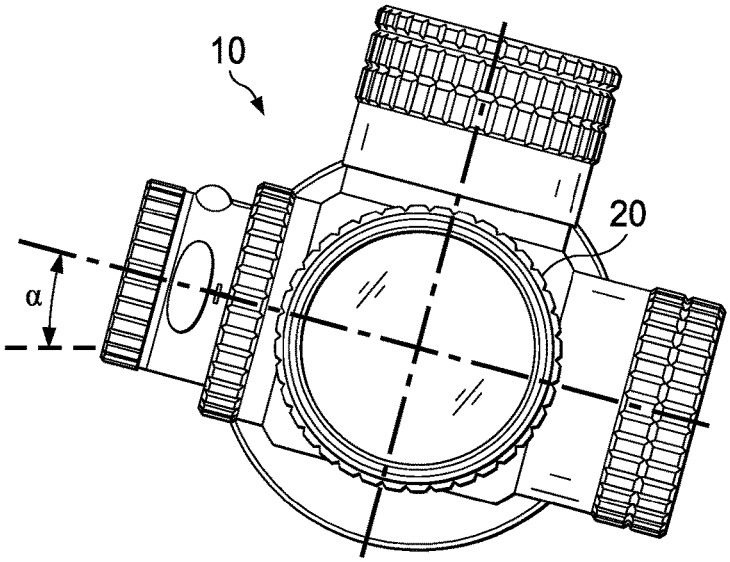
FIG. 14 is a rear view of the embodiment disclosed in FIG. 12 in which the rifle scope is tilted (canted) clockwise.

FIG. 14 is a rear view of the embodiment of rifle scope 10 illustrated in FIG. 13 in which rifle scope 10 is shown in a non-level, canted position. Accelerometer 66 on circuit board 60 detects angle a. Circuit board 60 determines angle a to be within or in excess of the predetermined allowable canting angle (for example, 1°) and only illuminates level LED 92 when angle a is within the allowable canting angle.

FIGS. 15-20 illustrate the operator's view through ocular lens 70 of eyepiece 20 in accordance with one embodiment of the invention. FIG. 15 illustrates a view of reticle 80 and level assembly 90 of rifle scope 10 in a non-powered mode (Mode 0). In this mode, reticle LED 82 and level LED 92 are not activated for illumination. As seen in this view, although not illuminated, the intersection of reticle 80 with bubble 100 indicates a non-canted inclination of rifle scope 10.

This is extremely advantageous in that rifle scope 10 is operative even when its electrical power source is depleted. As long as reticle 80 intersects bubble 100, the rifle is positioned within the predetermined amount of allowable tilt, and the operator need not look external to scope 10 for that determination. This is achieved by the precise design of the arc length of bubble 100 to represent the allowed angle of canting, and the positioning of level 98 is visible within optical lens 70 in alignment with reticle 80.

Figure 16:
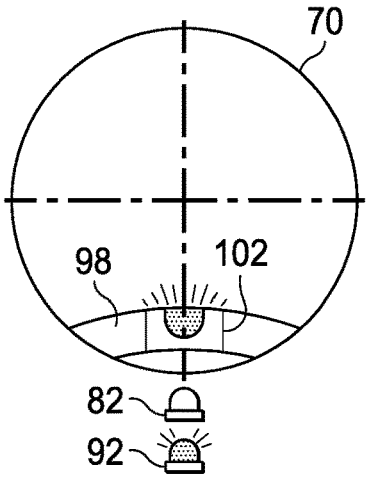
FIG. 16 illustrates the view through the eyepiece when the scope is in a first activation mode, in which the level indicates a non-canted inclination, and in which the level LED is illuminated to further indicate a non-canted inclination.

FIG. 16 illustrates reticle 80 and level assembly 90 of rifle scope 10 in Mode 1. In Mode 1, only level LED 92 is activated for illumination, and level LED 92 only illuminates when rifle scope 10 is in a non-canted inclination. As illustrated, level 98 indicates a non-canted inclination, and level LED 92 is thus illuminated. In one embodiment, level LED 92 is colored green to indicate "go". In one embodiment, the allowable amount of canting is less than one degree.

Figure 17:
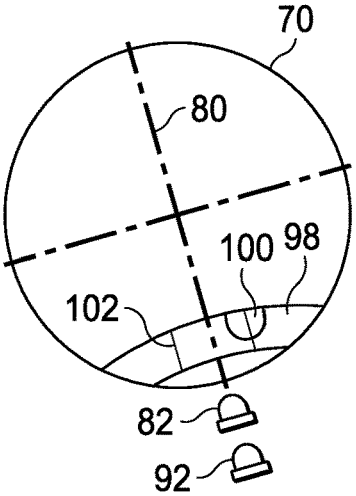
FIG. 17 illustrates the view through the eyepiece when the scope is in a first activation mode, where the level indicates a left canted inclination, and in which the level LED is not illuminated to further indicate an excessively canted inclination.

FIG. 17 illustrates rifle scope 10 still in Mode 1, as in FIG. 16. However, in FIG. 17, rifle scope 10 is excessively canted to the left such that LED 92 is not illuminated. Reticle 80 does not intersect bubble 100, confirming an excessively canted inclination.

Figure 18:
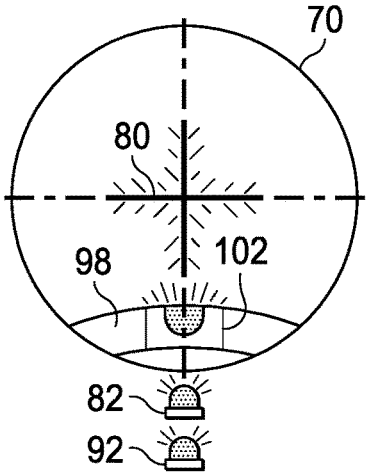
FIG. 18 illustrates the view through the eyepiece when the scope is in a second activation mode of an embodiment of the invention, in which the level indicates a non-canted inclination, and in which the level LED is illuminated to further indicate a non-canted inclination. The reticle is illuminated to assist with low light level shooting.

FIG. 18 illustrates reticle 80 and level assembly 90 of rifle scope 10 in Mode 2. In Mode 2, level LED 92 remains active as in activation Mode 1. In addition, LED 82 illuminates reticle 80, regardless of the canting angle. This mode is most useful in low light shooting. This condition is associated with dusk and dawn, which are prime hunting hours. As illustrated in FIG. 18, rifle scope 10 is not canted in excess of the allowable limit (e.g., one degree) such that reticle 80 and level 98 are both illuminated.

Figure 19:
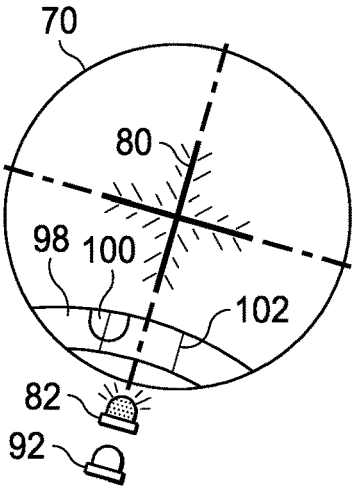
FIG. 19 illustrates the view through the eyepiece when the scope is in a second activation mode of an embodiment of the invention, in which the level indicates a right canted inclination, and in which the level LED is not illuminated to further indicate a canted inclination. The reticle is illuminated to assist with low light level shooting.

FIG. 19 illustrates rifle scope 10 still in activation Mode 2, as in FIG. 18. However, in FIG. 19, rifle scope 10 is excessively canted to the right such that level LED 92 is not illuminated. Level 98 confirms a right canted inclination in that reticle 80 does not intersect bubble 100. LED 82 continues to illuminate reticle 80 for low light targeting.

Figure 20:
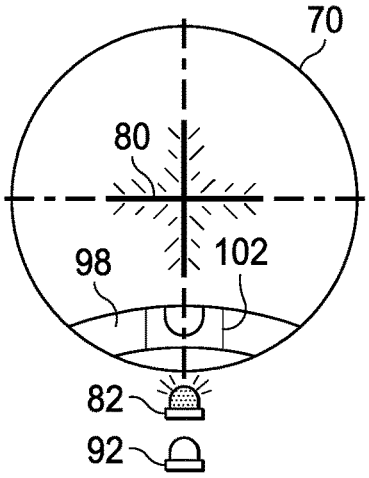
FIG. 20 illustrates the view through the eyepiece when the scope is in a third activation mode of an embodiment of the invention, in which the level indicates a non-canted inclination. The level LED is not powered in this mode. The reticle is illuminated to assist with low light level shooting.

FIG. 20 illustrates reticle 80 and level assembly 90 of rifle scope 10 in a third activation mode, or Mode 3. In Mode 3, LED 82 illuminates reticle 80, as in Mode 2. However, level LED 92 is not activated for illumination in Mode 3. Lighting of reticle 80 with reticle LED 82 is desired for targeting in early morning or early evening when external lighting is reduced. The operator may still rely on level 98 for inclination.

In one embodiment, LED 82 is preferably a different color than level LED 92. In one embodiment, level LED 82 is colored red to prevent confusion with level LED 92, which is preferably green.

In operation, rifle scope 10 operates similar to a telescope. As light from the target is received through objective lens 72, the image converges at a first focal plane reticle 80. At the first focal plane, the image is inverted. The image passes through a picture reversal assembly and reaches a second focal plane in eyepiece assembly 20. The magnification of the image is adjusted at the second focal plane. Eyepiece assembly 20 includes a diopter adjustment 22 to accommodate the operator's visual acuity, similar to the eyepiece on binoculars.

Reticle 80 can be located in front (front focal plane reticle) or behind (second focal plane reticle) the focus lens 74.

To adjust magnification, the operator turns magnification adjustment 24. A magnification lens moves toward objective lens 72 to increase magnification. The magnification lens moves toward ocular lens 70 to decrease magnification.

Windage turret 42 permits horizontal adjustments for wind. Elevation turret 44 permits vertical adjustments to compensate for the distance of the shoot. Parallax turret 46 permits focal length correction for long shots, bringing reticle 80 into focus with the target.

Unique to the present invention, canting turret 50 extends from parallax turret 46 to provide a conveniently controllable and reliable indication of proper level, or tilt, of the rifle to which scope 10 is attached. This indication is provided both mechanically and electrically, and by viewing the level 98 or green level LED 92 as seen inside rifle scope 10, and thus without interference with sighting of the target. Level 98, in combination with reticle 80, or indicia 102, provides a non-electrically reliant indication of proper level. Illumination of level LED 92 provides a positive, "no look" indication the rifle is level and within the predetermined limit of canting.

As illustrated, the invention provides a unique solution to the engineering constraints and challenges of providing a rapid identification of any undesirable canting in the rifle position while targeting. The disclosed embodiments provide the advantage of allowing the operator to know if the cant of the rifle is acceptable while keeping full focus on the reticle 80—target interface. In addition, the present embodiments allow the operator to determine if the cant of the rifle is acceptable without looking exterior of ocular lens 70 in the absence of an electrical power source 62 to scope 10.

As will be appreciated by a person of ordinary skill in the art, the sequence of the modes disclosed above may be reordered in any desired sequence without adversely affecting the overall operation of rifle scope 10, and without departing from the novelty and spirit of the disclosed invention. For example, the first and third modes could be reversed in order of operation. As another example, the second and third modes may be reversed in order of operation.

As used herein, the term "accelerometer" is intended for construction as meaning an instrument or sensor for measuring inclination and/or movement of the scope.

As used herein, the term "substantially" is intended for construction as meaning "more so than not".

As used herein, the term "circuit board" is intended for construction as meaning a printed circuit board or microcomputer with sufficient electrical elements and programming to perform the functions disclosed herein.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly in a manner consistent with the scope of the invention.

The invention claimed is:

1. A cant-indicating rifle scope comprising:

a body tube;

an eyepiece assembly on one end of the body tube;

an objective bell extending from an opposite end of the body tube;

a reticle located inside the body tube;

a reticle LED located inside the eyepiece assembly;

a turret system located on the body tube; and, a canting turret extending from the turret system;

the canting turret comprising:

a circuit board connectable to a battery power source;

an accelerometer connected to the circuit board;

an electrical lead connecting the circuit board to the reticle LED; and, an activation switch electrically connected to the circuit board;

a bubble level located between the reticle and an ocular lens;

the level visible through the eyepiece assembly;

the level having a bubble suspended in a fluid;

a level LED located beneath the level; and, wherein illumination of the level LED illuminates the level.

2. The cant-indicating rifle scope of claim 1, further comprising:

the turret system including an elevation turret, a windage turret, and a parallax turret; and, the canting turret extending outward from the parallax turret.

3. The cant-indicating rifle scope of claim 1, wherein:

the accelerometer detects an angle of canting of the rifle scope; and, the circuit board conditions illumination of the level LED upon the angle of canting being less than a predetermined angular amount.

4. The cant-indicating rifle scope of claim 3, further comprising:

the reticle visually intersecting the bubble when the rifle scope is within the predetermined angular amount of canting required to illuminate the level LED.

5. The cant-indicating rifle scope of claim 4, further comprising:

the bubble of the level having a length extending between a pair of opposite ends;

the length of the bubble representing 2 degrees of arc on the level.

6. The cant-indicating rifle scope of claim 3, further comprising:

the bubble having a length extending between a pair of opposite ends;

a pair of indicia centered on the level;

the indicia separated by a distance equal to the length of the bubble plus two times the predetermined angular amount; and, the bubble located between the indicia when the scope is within the predetermined angular amount.

7. The cant-indicating rifle scope of claim 1, the canting turret further comprising:

the battery power source being a replaceable battery power source.

8. The cant-indicating rifle scope of claim 1, the canting turret further comprising:

an illumination up switch electrically connected to the circuit board; and, an illumination down switch electrically connected to the circuit board.

9. The cant-indicating rifle scope of claim 1, further comprising:

a movement sensor connected to the circuit board for detecting movement of the rifle scope.

10. The cant-indicating rifle scope of claim 9, further comprising:

the movement sensor for detecting movement of the rifle scope being the accelerometer.

11. The cant-indicating rifle scope of claim 1, further comprising:

the reticle LED located beneath the reticle;

the reticle LED electrically connected to the circuit board; and, wherein illumination of the reticle LED illuminates the reticle.

12. The cant-indicating rifle scope of claim 11, further comprising:

the level LED being colored green; and, the reticle LED being colored red.

13. The cant-indicating rifle scope of claim 11, the further comprising:

the circuit board having a movement sensor for detecting movement of the rifle scope;

the circuit board having a plurality of operational modes, comprising:

a first mode in which power is supplied to the level LED and not to the reticle LED;

a second mode in which power is supplied to the reticle LED and the level LED;

a third mode in which power is supplied to the reticle LED and not to the level LED;

a fourth mode in which power is supplied to a timer of the circuit board and the movement sensor; and not to the reticle LED or the level LED; and, a non-activation mode in which the circuit board is unpowered; and wherein the first mode, second mode and third mode are selectable by pressing the activation switch;

wherein the fourth mode is automatically selected after the expiration of a first predetermined period of time in absence of any detection of movement by the movement sensor; and, wherein the non-activation mode is automatically selected after the expiration of a second predetermined period of time in absence of any detection of movement by the movement sensor.

14. The cant-indicating rifle scope of claim 13, further comprising:

wherein pressing the activation switch causes the circuit board to advance to the second mode when the circuit board is in the first mode;

wherein pressing the activation switch causes the circuit board to advance to the third mode when the circuit board is in the second mode; and, wherein pressing the activation switch causes the circuit board to advance to the first mode when the circuit board is in the third mode.

15. The cant-indicating rifle scope of claim 13, further comprising:

the timer measuring the first and the second predetermined period of time;

wherein movement of the rifle scope during the first predetermined period of time causes the circuit board to restart the timer;

wherein non-movement of the rifle scope during the first predetermined period of time causes the circuit board to advance to the fourth mode;

wherein the circuit board returns to the operational mode that was active prior to expiration of the first predetermined period of time when movement of the rifle scope is detected during the second predetermined period of time; and, wherein non-movement of the rifle scope during the second predetermined period of time causes the circuit board to power off.

16. The cant-indicating rifle scope of claim 1, further comprising:

a level assembly comprising:

a level frame;

the level mounted in the level frame; and, the level LED mounted to the level frame.

17. A cant-indicating rifle scope comprising:

a body tube;

an eyepiece assembly on one end of the body tube;

an objective bell extending from an opposite end of the body tube;

a reticle located inside the body tube;

a turret system located on the body tube comprising an elevation turret, a windage turret, and a parallax turret;

a canting turret extending outward from the parallax turret;

the canting turret comprising:

a circuit board connectable to a battery power source; and, an accelerometer connected to the circuit board and detectable of an angle of canting of the rifle scope;

a level located between the reticle and an ocular lens, and having a bubble suspended in a fluid;

a level LED located beneath the level and electrically connected to the circuit board; and, the circuit board conditioning illumination of the level LED upon the angle of canting being less than a predetermined angular amount.

* * * * *